United States Patent [19]

Henriksson

[11] Patent Number: 5,065,710

[45] Date of Patent: Nov. 19, 1991

[54] ROPE STARTER

[75] Inventor: Sören N. Henriksson, Kållered, Sweden

[73] Assignee: Aktiebolaget Electrolux, Stockholm, Sweden

[21] Appl. No.: 558,067

[22] Filed: Jul. 25, 1990

[30] Foreign Application Priority Data

Aug. 8, 1989 [SE] Sweden ..... 8902691

[51] Int. Cl.[5] ..... F02N 3/02

[52] U.S. Cl. ..... 123/185 B; 74/7 C; 192/41 S; 192/42

[58] Field of Search ..... 123/185 B, 185 BA, 185 A; 192/41 S, 42; 74/7 C

[56] References Cited

U.S. PATENT DOCUMENTS

| | | | |
|---|---|---|---|
| 1,132,160 | 3/1915 | Casgrain | 123/185 B |
| 2,177,199 | 10/1939 | Lansing | 123/185 A |
| 2,526,578 | 10/1950 | Righter | 123/185 B |
| 2,563,719 | 8/1951 | Goldberg et al. | 123/185 BA |
| 3,252,452 | 5/1966 | Burkett et al. | 123/185 A |

*Primary Examiner*—Andrew M. Dolinar

*Attorney, Agent, or Firm*—Pearne, Gordon, McCoy & Granger

[57] ABSTRACT

A rope starter working in such a way that a rope wheel (12) with a driver (25) rotates a fly-wheel by way of starting latches, and the fly-wheel being provided with support lugs as carriers (13,14) of the latches. When the engine starts the latches are swung out by the centrifugal force from the driver on the rope wheel. The support lugs are carriers of one of the latches as well as a stop for the other one.

6 Claims, 2 Drawing Sheets

ROPE STARTER

The present invention relates to a rope starter for an internal combustion engine with a rope wheel and a pull rope as well as a driver co-operating with latches on a rotating latch supporting member secured on the crankshaft on the engine.

In previously known embodiments of such apparatus the latches are made as levers journalled on pins screwed into a fly-wheel or the like rotating with the engine shaft and actuated by separate helical springs. A typical example of such a rope starter is described in the patent publication U.S. Pat. No. 2,563,719. The mounting of the latches takes a lot of time as many details and working operations are involved. This indicates a need of simplification which makes the design suitable for automatic methods, when mounting.

The purpose of the invention is to reduce the manufacturing cost, improve the working reliability and avoid making holes in the fly-wheel, as screw holes in it give a breaking indication in the material. As a solution in order to reach the purpose the latches are provided with contact surfaces against support lugs cast on the fly-wheel as well as tensioned spring members constituting input parts in grooves provided for this purpose in the support lugs. The advantages mentioned are intended to be obtained by providing these properties to the apparatus that are evident from the characteristics of claim 1.

Figure 1:
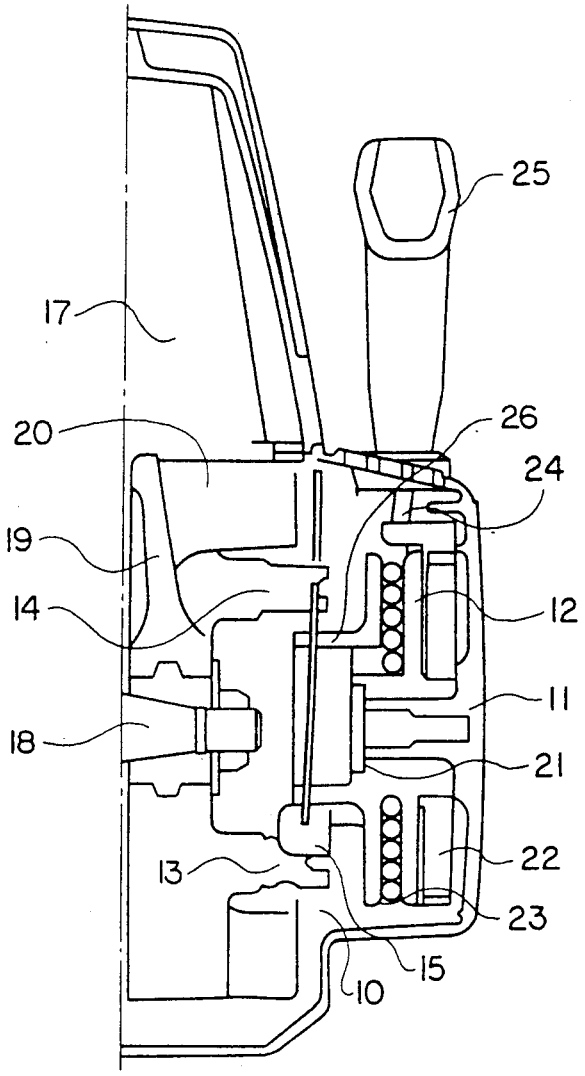
Figure 2:
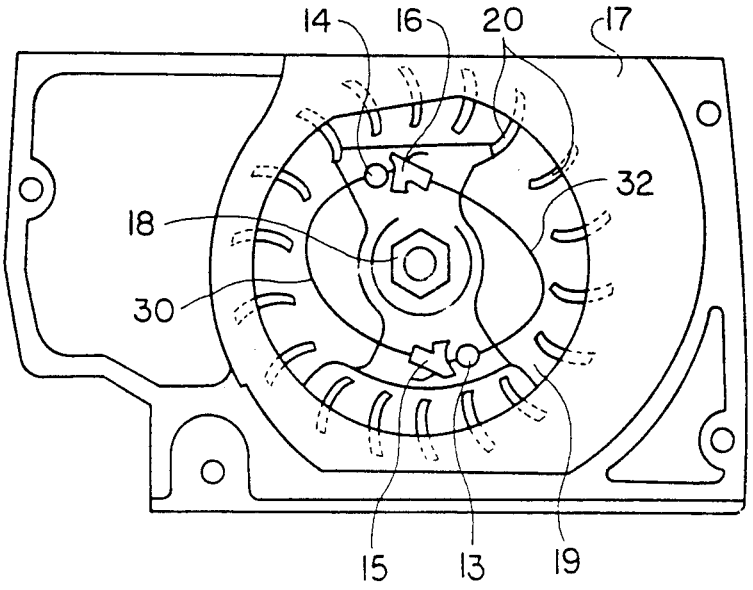

An embodiment of the apparatus according to the invention is described in the following with reference to the attached drawings illustrating in FIG. 1 the apparatus in an axial cross section, FIG. 2 a fly-wheel with starting latches in a horizontal projection, FIG. 3 a sketch showing the starting latches in a position prior to starting, FIG. 4 a sketch showing the starting latches in an operating position, FIG. 5 a sketch showing the starting latches in a non-operating position.

The apparatus shown includes an apparatus housing 10 with a central pivot 11 for a rope wheel 12 and supports 13, 14 of a couple of starting latches 15, 16. The apparatus housing is fixed to a fan housing 17 of an internal combustion engine with a crankshaft 18 to which a fly-wheel is secured having fan wings 20 and the supports 13, 14. The pivot 11 has at its end a flange 21, making contact with the rope wheel which is in the usual way provided with a return spring 22 and a groove 23 for a starting rope 24, the free end of which is penetrating an opening in the housing and provided with a handle 25 outside the housing.

The rope wheel has in the same vertical plane as the latches a bushing 26 with a couple of diametrically positioned recesses 27, 28 which are stop surfaces for the latches and a driver of them. In FIG. 3 the latches are shown in the case of a stopped engine. A hook 29 on each latch is entered into the corresponding recesses 27, 28. A spring member 30 to the latch 15 is fastened in a groove 31 of the support 14 which is diametrically positioned to the latch 15. The latch 16 has, in the same way, a spring member 32 fixed to the support 13 that is diametrically positioned to the latch 16. Each support 13, 14 has the shape of a cast support lug which besides carrying the spring parts 30, 32 serves as a stop for the outer end of the latch which is concave and fits against the support lug. FIG. 4 illustrates the contact between the outer end of each latch and the support lugs, which during the rotation of the rope wheel in the direction of the arrow 33 are driven in that movement. During the return movement of the rope wheel effected by the return spring 22 the latches take a position shown in FIG. 5, i.e. the hooks 29 which have a straight front and a sloping back, are moved out of the recesses 27, 28 so that the rope wheel can rotate freely when being returned.

Figures 3, 4, 5:
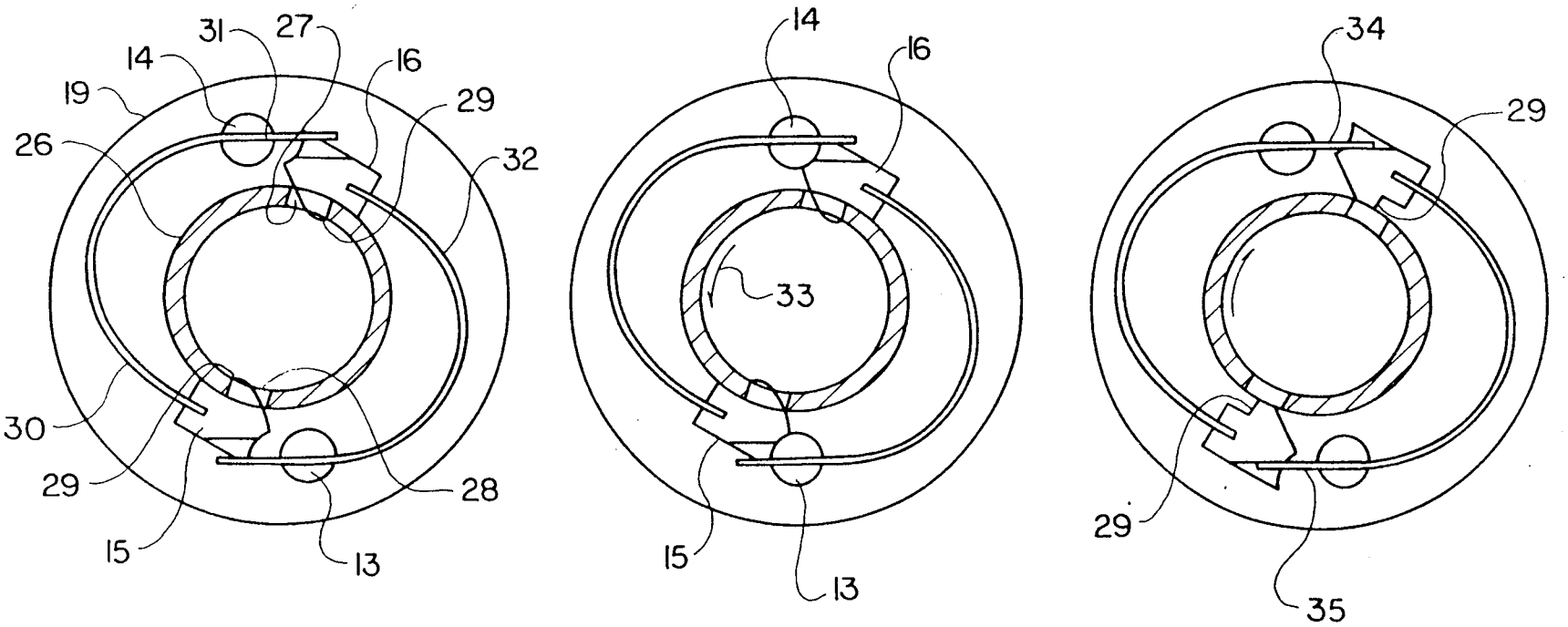

When the engine has started the latches are turned out by the centrifugal force towards a spring end 34, 35 at each support lug as illustrated in FIG. 5. The fly-wheel can then rotate freely in relation to the rope wheel. When the engine has stopped the latches return to the position shown in FIG. 3 as a result of the pretension of the spring members 30, 32 towards the center.

The now related function of a starter with co-rotating starting latches is part of the technical standpoint in this area. However, the invention differs from previous arrangements in the way that the start latches are fixed to the fly-wheel in support lugs that are supports of one of the latches as well as a stop for the other one. The arrangement according to the invention is thus very simple and is considered to have a good function security. As always in such apparatus details can be replaced by equally good ones without deviating from the inventive scope, e.g. the spring members are fixed to the lugs with other means than a groove, say a hard winding of the spring material round the lug. In the example described the support lugs have included both stop and supports. It will, however, be possible to separate those ones and in that way double the number of support lugs. The angle between the stop and the support can then be arbitrarily determined.

I claim:

1. A rope starter for an internal combustion engine including a rope wheel (12) with a starting rope (24) and a driver (26), said driver cooperating with starting latches (15,16) on a rotatable fly-wheel coaxial with the rope wheel, said fly-wheel being secured on the crankshaft of the engine, said fly-wheel being provided with support lugs projecting on the fly-wheel defining respective supports (13,14) for the starting latches (15,16), said starting latches surrounding said driver (26) and being each provided with a hook part (29) and a spring member (30,32), characterized in that each latch has its spring member extended in a curve and fixed to a respective support and the hook part connectable to the driver as well as to a stop means defined by a respective support lug.

2. A rope starter according to claim 1, characterized in that the spring member is extended beyond the support lug and forms a radial stop (34,35) for the latch co-operating with the lug.

3. A rope starter according to claim 1, characterized in that the spring member is put into a groove (31) in the support lug and pretensioned towards the center.

4. A rope starter according to claim 3, characterized in that the driver consists of a bushing (26) on the rope wheel and that said driver is provided with recesses (27,28) in which the hook parts 29 of the latches can be introduced.

5. A rope starter according to claim 4, characterized in that the hook parts penetrate into said recesses when infuenced by the pretension of the spring members towards the center.

6. A rope starter according to claim 2, characterized in that the latches make contact with said stops (34,35) when influenced by the centrifugal force of the rotating fly-wheel when the engine is operating.

* * * * *